US007111922B2

(12) United States Patent
Morita

(10) Patent No.: US 7,111,922 B2
(45) Date of Patent: Sep. 26, 2006

(54) PRINTING DEVICE

(75) Inventor: Toshiaki Morita, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 228 days.

(21) Appl. No.: 10/505,477

(22) PCT Filed: Feb. 21, 2003

(86) PCT No.: PCT/JP03/01967

§ 371 (c)(1),
(2), (4) Date: Aug. 24, 2004

(87) PCT Pub. No.: WO03/072363

PCT Pub. Date: Sep. 4, 2003

(65) Prior Publication Data

US 2005/0212849 A1 Sep. 29, 2005

(30) Foreign Application Priority Data

Feb. 26, 2002 (JP) ..... 2002-049064

(51) Int. Cl.
*B41J 2/165* (2006.01)

(52) U.S. Cl. ..... 347/35; 347/29

(58) Field of Classification Search ..... 347/35, 347/32, 29

See application file for complete search history.

(56) References Cited

U.S. PATENT DOCUMENTS

2002/0057301 A1* 5/2002 Ikeda ..... 347/8

FOREIGN PATENT DOCUMENTS

| | | | |
|---|---|---|---|
| JP | 6-963 | | 1/1994 |
| JP | 06015831 A | * | 1/1994 |
| JP | 7-266574 | | 10/1995 |
| JP | 7-314659 | | 12/1995 |
| JP | 7-314701 | | 12/1995 |
| JP | 2001-277546 | | 10/2001 |

* cited by examiner

*Primary Examiner*—Stephen Meier
*Assistant Examiner*—Rene Garcia, Jr.
(74) *Attorney, Agent, or Firm*—Wenderoth, Lind & Ponack, L.L.P.

(57) ABSTRACT

A printing apparatus which includes a printer body having a setting surface on which a printing surface of a printing medium is set horizontally, a carriage beam 23 which is attached to the printer body and extends in the direction along the setting surface, and a carriage 5 provided so as to be movable in the beam lengthwise direction with respect to the carriage beam 23, and further includes an ink head 6 equipped with a nozzle for discharging ink provided in the carriage, comprises:

a carriage supporting means 7 which supports the carriage 5 onto the carriage beam 23 in a manner enabling it to move up and down, an ink receiving part 8 which receives ink that is discharged from the ink head 6, and a receiving part supporting means 9 which supports the ink receiving part 8 on the carriage 5 in a manner enabling it to move to an ink receiving part below the ink head and a withdrawing position separated from the ink head 6.

4 Claims, 8 Drawing Sheets

PRINTING DEVICE

TECHNICAL FIELD

The present invention relates to an ink jet printing apparatus for printing a predetermined image on a printing medium that is mainly a fabric.

BACKGROUND ART

Conventionally, this type of printing apparatus prints a predetermined image pattern on a fabric set on a setting surface on which a printing medium is set by moving a carriage equipped with an ink head using the ink jet method, horizontally to the setting surface.

Concretely, the carriage is supported on a carriage beam in a manner enabling it to reciprocate, and the carriage beam is supported on the printer body having the setting surface in a manner enabling the carriage beam to reciprocate in the direction orthogonal to the carriage moving direction.

Then, a control device for controlling the driving of the carriage beam, the carriage, and the ink head is provided, image data of images of a-pattern to be printed on a fabric is recorded in advance on the control device, and when printing, ink is discharged from the nozzle of the ink head according to the image data to print the predetermined image on the surface of a fabric.

The ink head of the ink jet printing apparatus has eight unit heads for individually discharging of ink in dark and light colors of four colors including, for example, yellow, magenta, cyan, and black, that is, ink of eight colors.

Then, when printing, an ink necessary for printing is selected in these eight unit heads and the determined ink is discharged from the nozzle of the selected unit head.

Since an ink of a predetermined unit head is selected when printing, depending on the image to be printed, the time interval from discharge to the next discharge from the unit heads may become longer, and as a result, ink discharge may not be carried out for a definite period of time or more. In this case, ink adhering to the nozzle is dried and the discharge opening of the nozzle is clogged.

Therefore, in the ink jet printing apparatus described above, in order to prevent the nozzle of the ink head from being clogged, for example, it is common that flushing to forcibly discharge the ink from the nozzle of the ink head is carried out when a predetermined period of time elapses from the start of execution of the printing processing.

Then, in the case where flushing is carried out in the conventional ink jet printing apparatus, the carriage with the ink head is moved to a non-printing region outside a moving region for printing an image, and the nozzle of the ink head is moved closer to an ink recovery tank that is disposed in the non-printing region, and thereafter, a predetermined amount of ink is discharged from the opening of the nozzle into the ink recovery tank.

However, in the above-described printing apparatus, when flushing is carried out during the printing processing, as mentioned above, the carriage must be moved to the non-printing region outside the moving region for printing, and after the flushing is finished, the carriage must be returned to the printing region again, and this results in a lengthened printing time in total.

On the other hand, in order to solve the above-described problem, for example, a printing apparatus is disclosed in Japanese Published Unexamined Patent Application No. H09-11502, wherein the ink recovery tank for the ink discharged from the nozzle of the ink head is installed in the apparatus main body together with the carriage with the ink head, and the carriage is supported onto the apparatus main body in a manner enabling it to freely swing.

In this printing apparatus, the ink recovery tank is fixed at a position apart from the printing object setting surface that is to be regarded as a printing position in the apparatus main body, and the carriage is supported onto the apparatus main body in a manner enabling it to swing so that the nozzle of the ink head can be moved to the printing position and a position opposite the ink recovery tank.

During image printing, the nozzle of the ink head is positioned at the printing position, and in the middle of image printing, when a predetermined period of time elapses in regard to an unused unit head, the nozzle of the ink head is swung to the position opposite the ink recovery tank for flushing the ink and a predetermined amount of ink is discharged from the nozzle into the ink recovery tank.

However, in the above-described carriage swing type printing apparatus, although the problem that lengthens the period of time required for printing is solved, if the printing area is increased as in the case of a printing apparatus for printing onto a fabric, the ink supply amount must be increased and this inevitably makes the carriage large, so that a large space is required for swinging the carriage.

Particularly, when it is demanded that the ink types are increased and the number of unit heads of the ink head is increased, the carriage becomes larger, so that the swinging space cannot be secured and the number of unit heads cannot be increased.

In addition, when the large-sized carriage is swung, the distance from its pivot to the center of gravity lengthens, so that the swinging mechanism for swinging the heavy carriage against the gravitational force is also increased in size for obtaining strength to withstand the swinging motion, and as a result, the entirety of the printing apparatus is increased in size.

The present invention has been developed in view of the above-described circumstances, and an object thereof is to provide a printing apparatus which can carry out flushing of ink at a predetermined timing even when an ink head is positioned at an arbitrary position above a printing object without an increase in size of the printing apparatus and without an increase in total time required for printing.

DISCLOSURE OF THE INVENTION

In order to achieve the abovementioned object, the printing apparatus of the invention comprises an printer body having a setting surface on which a printing surface of a printing medium is horizontally set, a carriage beam that is attached to the printer body and extends in the direction along the setting surface, and a carriage provided so as to be movable in the beam lengthwise direction with respect to the carriage beam, and is equipped with an ink head which is mounted on the carriage and has a nozzle for discharging ink, wherein the carriage is provided with a carriage supporting means for supporting the carriage on the carriage beam in a manner enabling the carriage to move up and down, an ink receiving part for receiving ink discharged from the ink head, and a receiving part supporting means for supporting the ink receiving part in a manner enabling it to to reciprocate between an ink receiving part below the ink head and a withdrawn position separated from the ink head while maintaining the horizontal posture. Thereby, with the simple structure in which the carriage is raised and lowered, flushing can be carried out as appropriate even during printing processing by advancing or retreating the ink receiving part.

As a result, even without the swinging mechanism for swinging the carriage used in the prior art, it becomes possible to carry out printing processing while flushing is carried out as appropriate without an increase in size of the entire apparatus and without an increase in the printing period, and as a whole, the printing yield can be improved.

Furthermore, in the printing apparatus of the present invention, the receiving part supporting means is provided with a holder to which the ink receiving part is attached, a receiving part moving motor, and a link mechanism which links the drive shaft of the receiving part moving motor and the holder and moves the holder according to the rotational driving of the receiving part moving motor so that the ink receiving part moves between the ink receiving position and the withdrawn position.

Thereby, when printing, printing processing can be carried out without interference by the ink receiving part, and when flushing, ink discharged from the ink head can be securely received by the ink receiving part.

Furthermore, in the printing apparatus of the present invention, the receiving part supporting means is provided with a holder to which the ink receiving part is attached, a receiving part moving motor, and a link mechanism which links the drive shaft of the receiving part moving motor and the holder and moves the holder according to the rotational driving of the receiving part moving motor so that the ink receiving part moves between the ink receiving position and the withdrawn position while maintaining the horizontal posture.

Thereby, flushing can be smoothly carried out by automatic control.

BEST MODE FOR CARRYING OUT THE INVENTION

Figure 1:
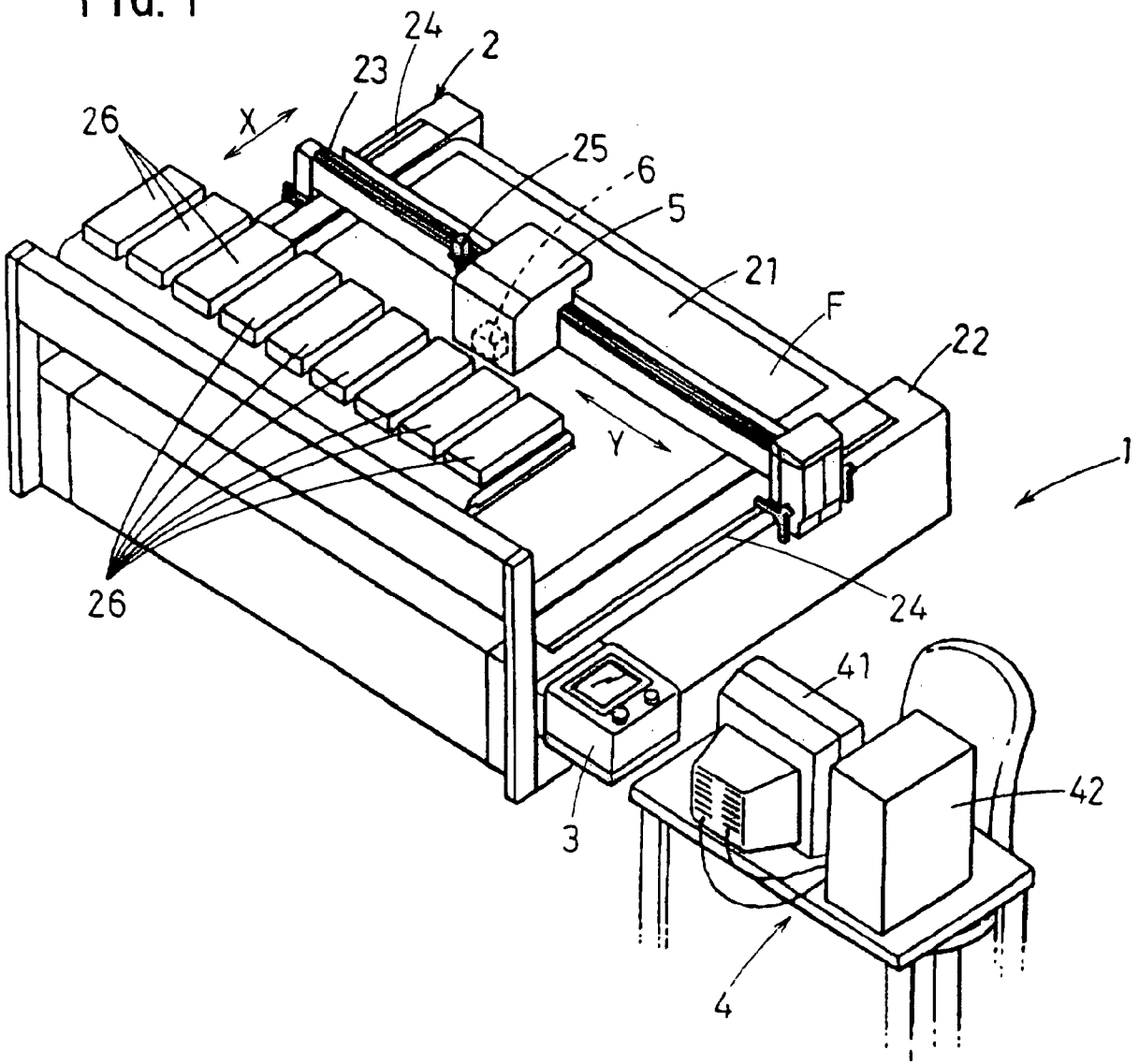
FIG. 1 is a constructional view showing a first embodiment of a printing apparatus relating to the invention.

Hereinafter, the printing apparatus relating to the invention is described with reference to the drawings. In FIG. 1, the printing apparatus indicated by the reference numeral 1 is used for printing images on the surface of a fabric F such as knitted fabric or woven fabric.

This printing apparatus 1 comprises an ink jet printer 2 for printing images on the surface of the fabric F, a control device 3 mainly composed of a computer for controlling the driving of the printer 2 and an image data creating device 4 to be connected to the control device 3.

The image data creating device 4 is for creating image data to be printed onto the fabric F, etc., and comprises a monitor 41 and an image data creating control device 42 shown in FIG. 1, and a key board that is not shown.

The printer 2 includes, as shown in FIG. 1, a printer body 22 having a setting surface 21 for setting the fabric F, a carriage beam 23 attached to two guide rails 24 provided on the printer body 22 so as to be movable in the X direction of FIG. 1, and a carriage 5 provided along the lengthwise direction of the carriage beam 23 in a movable manner.

The setting surface 21 is formed so that the printing surface of the fabric F is horizontally set thereon, and the carriage beam 23 is disposed on the guide rails 24 so as to extend along the setting surface 21 in the direction (Y direction in FIG. 1) orthogonal to the X direction, and the carriage 5 is attached to the carriage beam 23 via a carriage supporting means 7 described later so as to be movable in the Y direction.

The carriage 5 is equipped with an ink head 6 which carries out printing by discharging ink from a nozzle (not shown) onto the surface of the fabric F on the setting surface 21, and a CCD camera 25 for mainly reading the status of the fabric F placed on the setting surface 21.

The ink head 6 is inserted inside the carriage case 51 of the carriage 5, and on one side surface of the carriage case 51 (FIG. 2 and FIG. 3), a screw shaft holder 52 and two guide shaft holders 53 and 53 are fixed.

The ink head 6 (FIG. 4) comprises eight unit heads 61 for individually discharging of ink in dark and light colors of four colors including yellow, magenta, cyan, and black, that is, ink in eight colors. Furthermore, in the respective unit heads 61, a plurality of nozzles for discharging of ink are formed although they are not shown.

Furthermore, a plurality of ink tanks 26 are mounted on one side upper part of the printer body 22, and inside the printer body 22, a driving device for moving the carriage beam 23 with respect to the guide rails 24 and moving the carriage 5 with respect to the carriage beam 23 is provided.

Ink of eight colors of dark and light colors of the four yellow, magenta, cyan, and black colors and an ink head cleaning liquid are individually put in the respective ink tanks 26 so as to correspond to the unit heads 61.

Then, in response to driving of the driving device, the carriage 5 is moved in the Y direction and the carriage beam 23 is moved in the X direction, whereby the ink head 6 is two-dimensionally moved on the setting surface 21.

On the other hand, in the control device 3, image data created by the image data creating device 4 is recorded. As image data, printing positions of a plurality of parts required for sewing a cloth including a front body, a rear body, and sleeves, etc., onto a fabric F, and patterns to be printed for each part are recorded.

Figure 2:
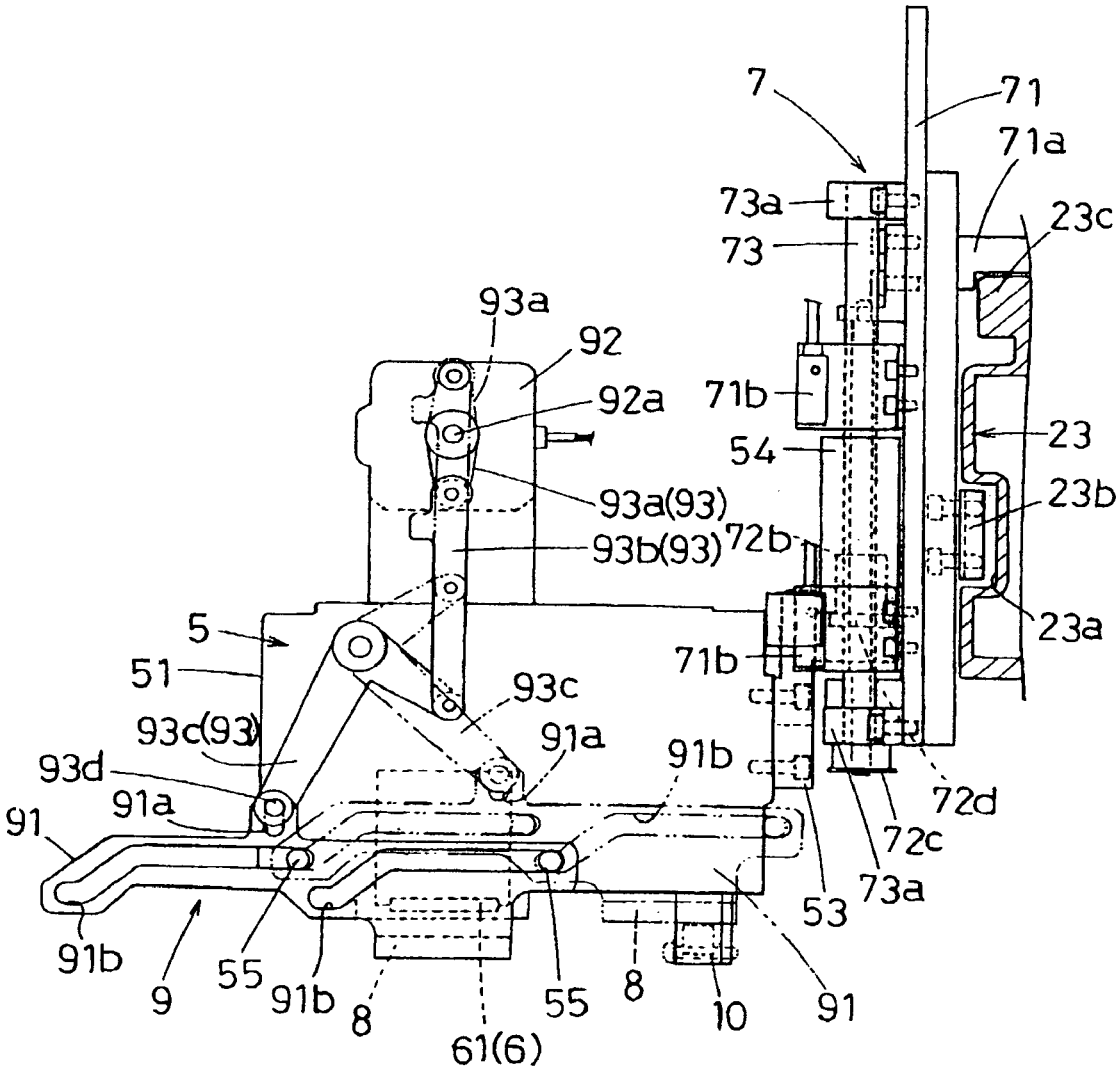
FIG. 2 is a side view of a carriage forming the printing apparatus relating to the first embodiment.

In this embodiment, as shown in FIG. 2 through FIG. 5, the printing apparatus structured as mentioned above comprises a carriage supporting means 7 which supports the carriage 5 onto the carriage beam 23 in a manner enabling it to move up and down, an ink receiving part 8 which receives ink discharged from the ink head 6, and a receiving part supporting means for supporting the ink receiving part 8 onto the carriage 5 in a manner enabling the ink receiving part to move to the ink receiving position below the ink head 6 (position shown by the solid line in FIG. 2) and a withdrawn position separated from the ink head 6 (position shown by the imaginary line of a long and short two-dashed line in FIG. 2).

Figure 3:
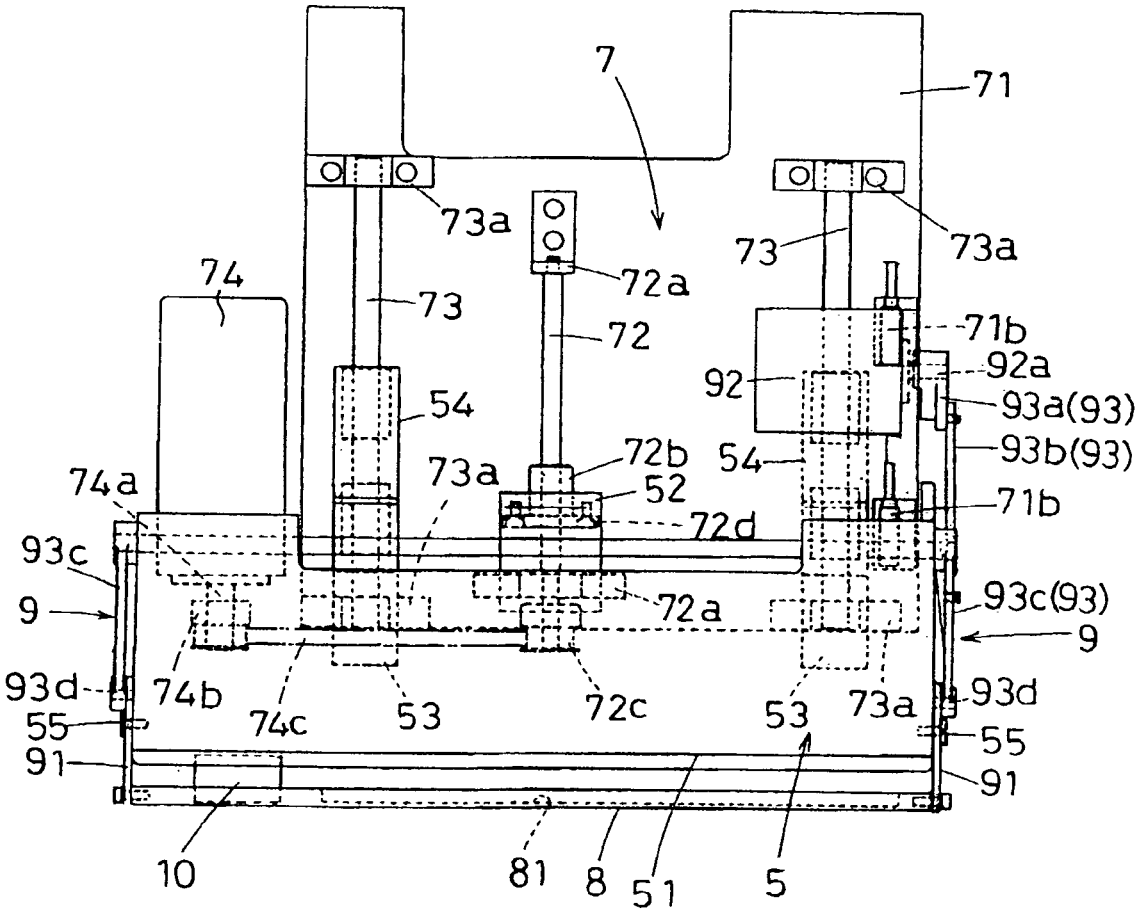
FIG. 3 is a front view of the carriage forming the printing apparatus relating to the first embodiment.
Figure 4:
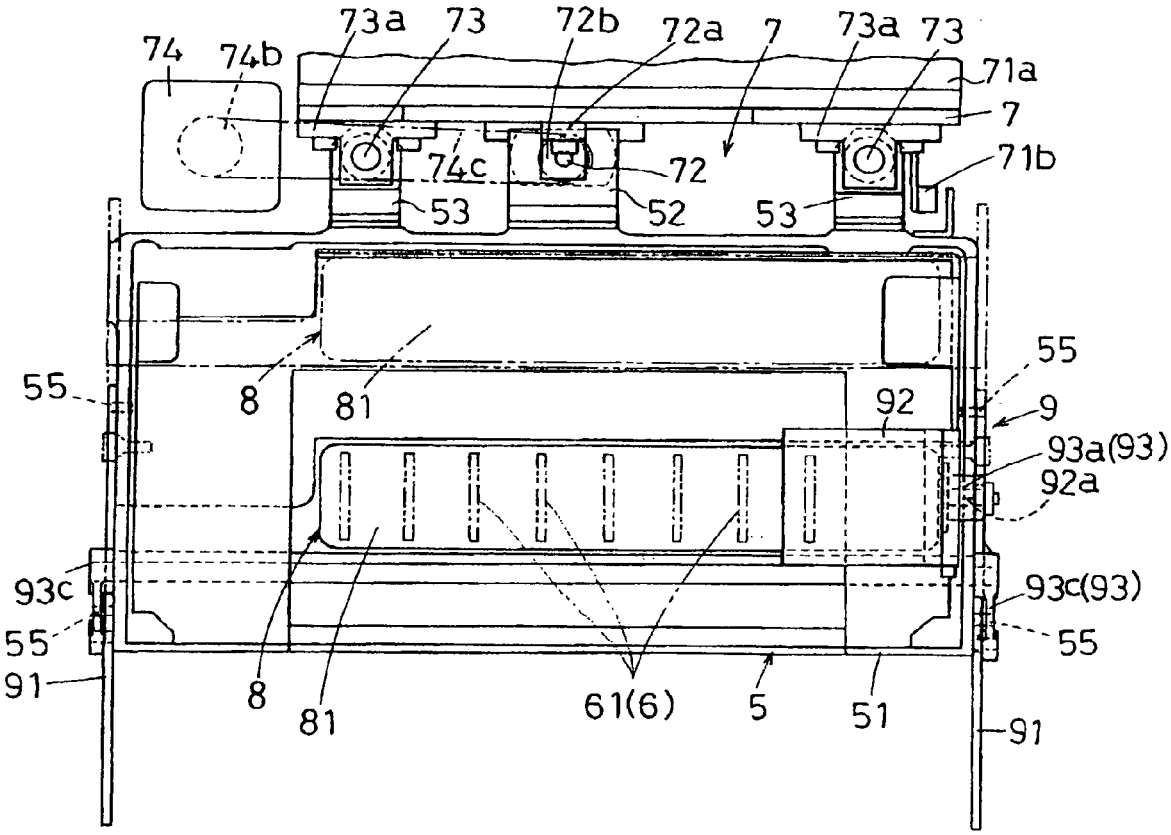
FIG. 4 is a top view of the carriage forming the printing apparatus relating to the first embodiment.

The carriage supporting means 7 mainly comprises, as shown in FIG. 2, FIG. 3, and FIG. 4, a plate-shaped supporting member 71 supported by the carriage beam 23 in a manner enabling it to reciprocate along the lengthwise direction of the carriage beam 23, a screw shaft 72 attached to almost the center of this plate-shaped supporting member 71, guide shafts 73 attached to the plate-shaped supporting member 71 on both sides of the screw shaft 72, a carriage raising and lowering motor 74 for raising and lowering the carriage 5, and a screw shaft holder 52 fixed to one side surface of the carriage case 51 and two guide shaft holders 53 and 53.

In the carriage beam 23, a belt laying groove 23*a* is formed so as to extend in the lengthwise direction, and in this belt laying groove 23*a*, a beam belt 23 is disposed so as to be rotatable forward and backward.

The plate-shaped supporting member 71 is fixed to a part of the beam belt 23*b* provided on the carriage beam 23 on the back surface side, and at the upper part of the back surface side of the plate-shaped supporting member 71, a guided part 71*a* to be guided along a guide part 23*c* formed on the upper surface part of the carriage beam 23 is formed.

The plate-shaped supporting member 71 is formed so as to reciprocate in the lengthwise direction of the carriage beam 23 in response to the rounding of the beam belt 23*b* provided on the carriage beam 23. When the plate-shaped supporting member 71 reciprocates, the guided part 71*a* of the plate-shaped supporting member 71 is guided along the guide part 23*c* of the carriage beam 23 so that the plate-shaped supporting member 71 smoothly reciprocates with respect to the carriage beam 23.

The screw shaft 72 is rotatably supported via upper and lower screw shaft bearings 72*a* and 72*a*, and the screw shaft 72 is screwed with a nut 72*b* and attached with a screw shaft side pulley 72*c* at the lower end of the screw shaft 72. Then, by laying a driving belt 74*c* across a motor side pulley 74*b* attached to the drive shaft 74*a* of the carriage raising and lowering motor 74 and the screw shaft side pulley 72*c*, the screw shaft 72 is rotated in response to the rotational driving of the carriage raising and lowering motor 74.

Furthermore, on the outer circumferential surface of the nut 72*b* screwed with the screw shaft 72, a flange part 72*d* is formed, and the screw shaft holder 52 fixed to the carriage case 51 is fixed to the flange part 72*d* of the nut 72*b*.

The two guide shafts 73 are supported via upper and lower guide shaft bearings 73*a* and 73*a*. Furthermore, in the guide shaft holders 53 and 53 fixed to the carriage case 51, guide cylinder parts 54 for inserting the guide shafts 73 are formed.

These guide shafts 73 are inserted into the guide cylinder parts 54 of the guide shaft holders 53 and 53, and the screw shaft holder 52 is fixed to the nut 72*b* of the screw shaft 72, whereby when the screw shaft 72 rotates in response to the rotational driving of the carriage raising and lowering motor 74, the carriage case 51 moves up and down together with the nut 72*b* with respect to the plate-shaped supporting member 71 while being guided by the guide shafts 73.

Furthermore, to the carriage case 51, as shown in FIG. 2 through FIG. 4, the ink receiving part 8 for receiving ink discharged from the nozzle of the ink head 6 is attached via the receiving part supporting means 9.

The ink receiving part 8 has, as shown in FIG. 4, a concave-shaped receiving surface 81 which is long in a plan view and receives ink from all the unit heads 61 of the ink head 6, and is disposed on the lower side of the carriage case 51.

The receiving part supporting means 9 comprises a receiving part holder 91 to which the ink receiving part 8 is attached, a receiving part moving motor 92, and a link mechanism 93 which links a receiving part drive shaft 92*a* of the receiving part moving motor 92 and the receiving part holder 91 and moves the receiving part holder 91 so that the ink receiving part 8 can move between the ink receiving position and the withdrawn position according to the rotational driving of the receiving part moving motor 92.

The receiving part holder 91 is formed of, as shown in FIG. 2 through FIG. 4, a long-length member to be fixed to both lengthwise ends of the ink receiving part 8. The receiving part holder 91 is formed with a concave groove 91*a* into which a holder linking pin 93*d* of the link mechanism 93 is fitted and two V-shaped guide holes 91*b* into which guide pins 55 projectedly provided on the carriage case 51 are fitted. The receiving part holder 91 is disposed on the carriage case 51 so that its lengthwise direction becomes horizontal.

The receiving part moving motor 92 is disposed above the carriage case 51 as shown in FIG. 2 through FIG. 4, so as to be rotatable forward and backward.

The link mechanism 93 comprises a first link 93*a* fixed to the receiving part drive shaft 92*a* of the receiving part moving motor 92, a linear second link 93*b* to be linked to the first link 93*a*, and an L-shaped third link 93*c* to be linked to the second link 93*b*.

The first link 93*a* is fixed on its one end in the lengthwise direction to the receiving part drive shaft 92*a* of the receiving part moving motor 92, and the second link 93*b* is pivotally supported on its one end side in the lengthwise direction to the other end of the first link 93*a*, and the other end side of the second link is pivotally supported to a short side end of the third link 93*c*. The third link 93*c* is supported onto the carriage case 51 in a manner enabling it to swing around the L-shaped bent portion, and on its long side end, a holder linking pin 93*d* is provided.

In the receiving part holder 91, the guide pins 55 projectedly provided on the carriage case 51 are fitted into the guide holes 91*b* and the holder linking pin 93*d* of the third link 93*c* is fitted into the concave groove 91*a* of the receiving part holder 91, whereby the receiving part holder 91 is prevented from dropping from the predetermined position of the carriage case 51 by being sandwiched by the carriage case 51 and the third link 93*c*.

The operations of the link mechanism 93 and the operations of the receiving part holder 91 in this embodiment are described with reference to FIG. 6 and FIG. 7. When the receiving part moving motor 92 is driven to rotate by 180 degrees forward, the first link 93*a* of the link mechanism 93 rotates around the receiving part drive shaft 92 from the state shown by the solid line of FIG. 6 into the state shown by the solid line of FIG. 7 and the state shown by the imaginary line of FIG. 7 in order. At this point, the portion of the first link 93*a* linked to the second link 93*b* eccentrically rotates, so that the second link 93*b* pivotally supported by the first link 93*a* moves so as to swing the short side of the third link 93*c* vertically in conjunction with the motion of the first link 93*a*. Then, the long side end of the third link 93*c* moves so as to represent an arc around the swinging center.

According to the motion of the third link 93*c*, the receiving part holder 91 to which the holder linking pin 93*d* of the third link 93*c* is fitted and the ink receiving part 8 move from the condition shown by the imaginary lines of FIG. 2 (the withdrawn position of the ink receiving part 8) to the condition shown by the solid lines of FIG. 2 (the ink receiving position of the ink receiving part 8).

Furthermore, when the receiving part moving motor 92 is driven to rotate by 180 degrees in reverse from the condition shown by the solid lines of FIG. 2 (the ink receiving position of the ink receiving part 8), due to the motion in reverse from the above-described motion, the receiving part holder 91 and the ink receiving part 8 move from the condition shown by the solid lines of FIG. 2 (the ink receiving position of the ink receiving part 8) to the condition shown by the imaginary lines of FIG. 2 (the withdrawn position of the ink receiving part 8).

In this embodiment, the drive control for moving the ink receiving part 8 between the ink receiving position of the ink receiving part 8 and the withdrawn position of the ink receiving part 8 is carried out by using the control device 3 as a control means.

Namely, when printing by the ink head 6 is carried out, the control device 3 drives the carriage supporting means 7 so as to lower the carriage 5 to the position that enables the printing by the ink head 6 and controls to drive the receiving part supporting means 9 so that the ink receiving part 8 is positioned at the withdrawn position.

In addition, when printing by the ink head 6 is not carried out and flushing of ink is carried out, control is made to drive the carriage supporting means 7 so as to raise the carriage and to drive the receiving part supporting means 9 so as to position the ink receiving part 8 at the ink receiving position.

Furthermore, the positions of the carriage 5 when moving up and down are determined on the basis of the number of revolutions of the carriage raising and lowering motor 74, and the upper limit position and the lower limit position of the carriage 5 are detected by two position sensors 71*b* attached to the plate-shaped supporting member 71.

Figure 5:
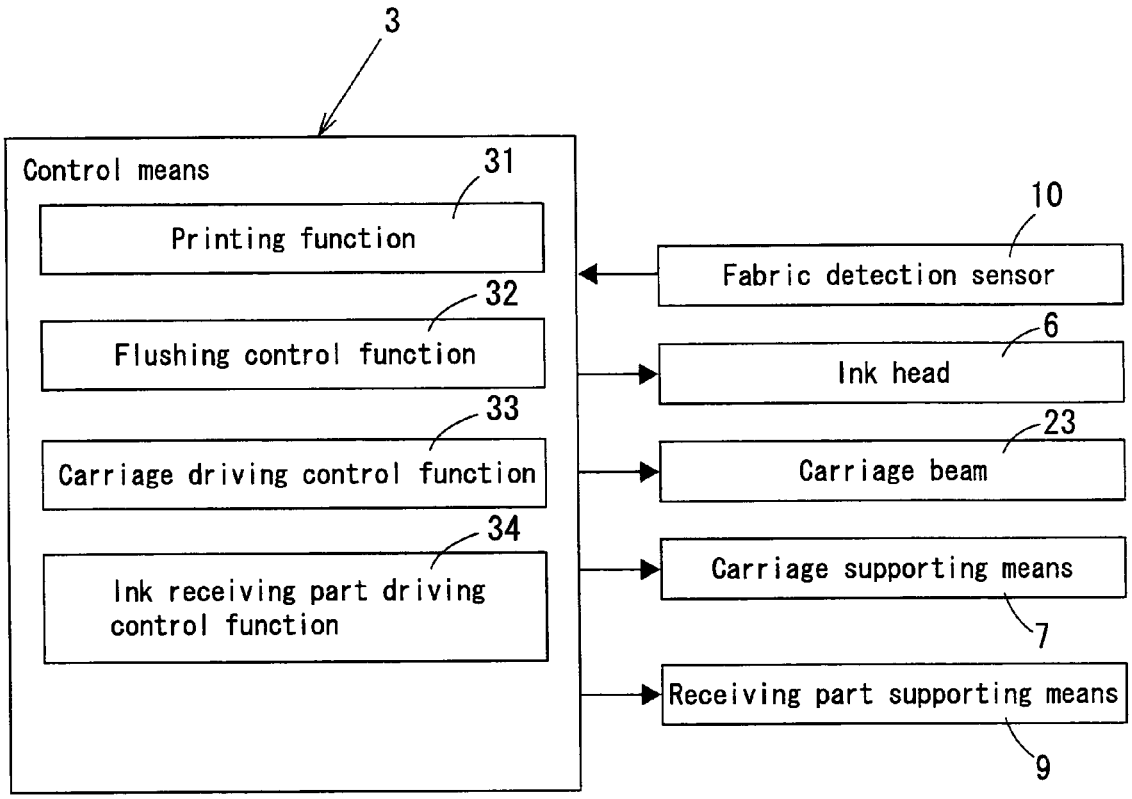
FIG. 5 is a block diagram of a control device.

In order for the control device 3 to make this control, in this embodiment, as shown in FIG. 5, on the program of the computer composing the control device 3, a printing function 31 for printing on the basis of image data stored in a storage 31 of the control device 3, a flushing control function 32 for controlling the ink head 6 so as to discharge (flushing) ink from the nozzle of the ink head 6 at a predetermined timing, a carriage driving control function 33 for lowering the carriage 5 to the printing position with respect to the carriage beam 23 when printing and raises the carriage 5 so as to separate from the setting surface 21 when flushing, and an ink receiving part driving control function 34 for moving the receiving part supporting means 9 so as to position the ink receiving part 8 at the withdrawn position when printing and to position the ink receiving part 8 at the ink receiving position when flushing, are constructed.

The flushing is carried out when printing is started, at a predetermined timing during printing, and when printing is finished.

In this embodiment, as shown in FIG. 2 and FIG. 3, a fabric detection sensor 10 is attached to the bottom of the carriage 5 so as to be movable up and down with respect to the carriage case 51.

When the fabric detection sensor 10 is used, the fabric detection sensor 10 is positioned at the lowest position with respect to the carriage case 51, and when the fabric detection sensor 10 is not used, the fabric detection sensor 10 is raised to a position which does not disturb the printing operation.

The position of printing by the ink head 6 is determined depending on the distance (vertical height) between the ink head 6 and the fabric F, and in this embodiment, the fabric detection sensor 10 is used for determining the height of the ink head 6.

The fabric detection sensor 10 is positioned at the lowest position with respect to the carriage case 51 and the upper surface of the fabric F is detected while the carriage 5 is moved down toward the setting surface 21 on the basis of the carriage driving control function 33, and based on the detection results, the printing position is determined in the control device 3.

When printing by the printing apparatus 1 of the above-described embodiment is started, the ink head 6 two-dimensionally moves above the fabric F together with the carriage 5 on the basis of the printing function 31 of the control device 3, ink is discharged to a predetermined position on the surface of the fabric F from the ink head 6 according to a set image pattern, and a predetermined image pattern corresponding to the image data is printed on the surface of the fabric F.

At this point, by the control of the carriage driving control function 33, the driving control of the carriage supporting means 7 is carried out so that the carriage 5 is positioned at the printing position with respect to the carriage beam 23, and by the control of the ink receiving part driving control function 34, the driving control is carried out so that the ink receiving part 8 is positioned at the withdrawn position separated from the ink head 6.

Then, in the process of printing of the image pattern, when flushing is carried out by discharging a predetermined amount of ink from the nozzle of the ink head 6 by the control of the flushing control function 32, before flushing, the driving control of the carriage supporting means 7 is carried out so that the ink receiving part 8 can be positioned below the ink head 6 by the control of the carriage driving control function 33, and by the control of the ink receiving part driving control function 34, the driving control of the receiving part supporting means 9 is carried out so that the ink receiving part 8 is positioned at a position where it can receive ink discharged from the ink head 6.

Due to these controls, when the ink receiving part 8 is positioned at the ink receiving position, by the control of the flushing control function 32, flushing is carried out by discharging a predetermined amount of ink from the nozzle of the ink head 6 and the ink is discharged onto the ink receiving part 8.

Thus, according to the printing apparatus of the embodiment described above, only with the structure in which the carriage 5 is raised and lowered, flushing can be carried out even during printing as appropriate by advancing and retreating the ink receiving part 8.

As a result, even without the conventional swinging mechanism for swinging the carriage, it becomes possible to carry out printing while flushing is carried out as appropriate without an increase in size of the entire apparatus and without an increase in printing period, whereby the printing yield is improved overall.

Furthermore, in this embodiment, even if the thickness of the fabric F is changed, the vertical position of the carriage 5 can be set at a printing position at which the nozzle of the print head 6 is not in contact with the fabric F according to the thickness of the fabric F by the driving of the carriage raising and lowering motor 74. Therefore, it is also possible that the ink receiving part 8 is made to advance and retreat for flushing by efficiently using the structure of adjusting the printing position.

As image data to be created by the image data creating device 4, image data is crated by properly arranging image patterns of a plurality of parts including a front section, a rear section, and sleeves according to a region with the size of the fabric F to be printed, however, the invention is not limited to this, and for example, image data including image patterns formed on almost the entire surface of the fabric F by only leaving both ends in the width direction of the fabric F, that is, so-called selvedges can be used.

Furthermore, the printing medium is not limited to fabric F, and for example, a paper can be used as the printing medium.

Furthermore, in this embodiment, flushing is carried out so as to discharge ink simultaneously from all unit heads, however, it is also possible that ink that is not used for a predetermined period during printing of the image patterns is judged and the ink is automatically discharged from the nozzle of the predetermined unit head 61 based on the judgement results by the control device 3.

Furthermore, the period in which the ink is not used is set as the flushing causing parameter, however, the parameter is not limited to this and may be the moving distance of the carriage 24.

Figure 8:
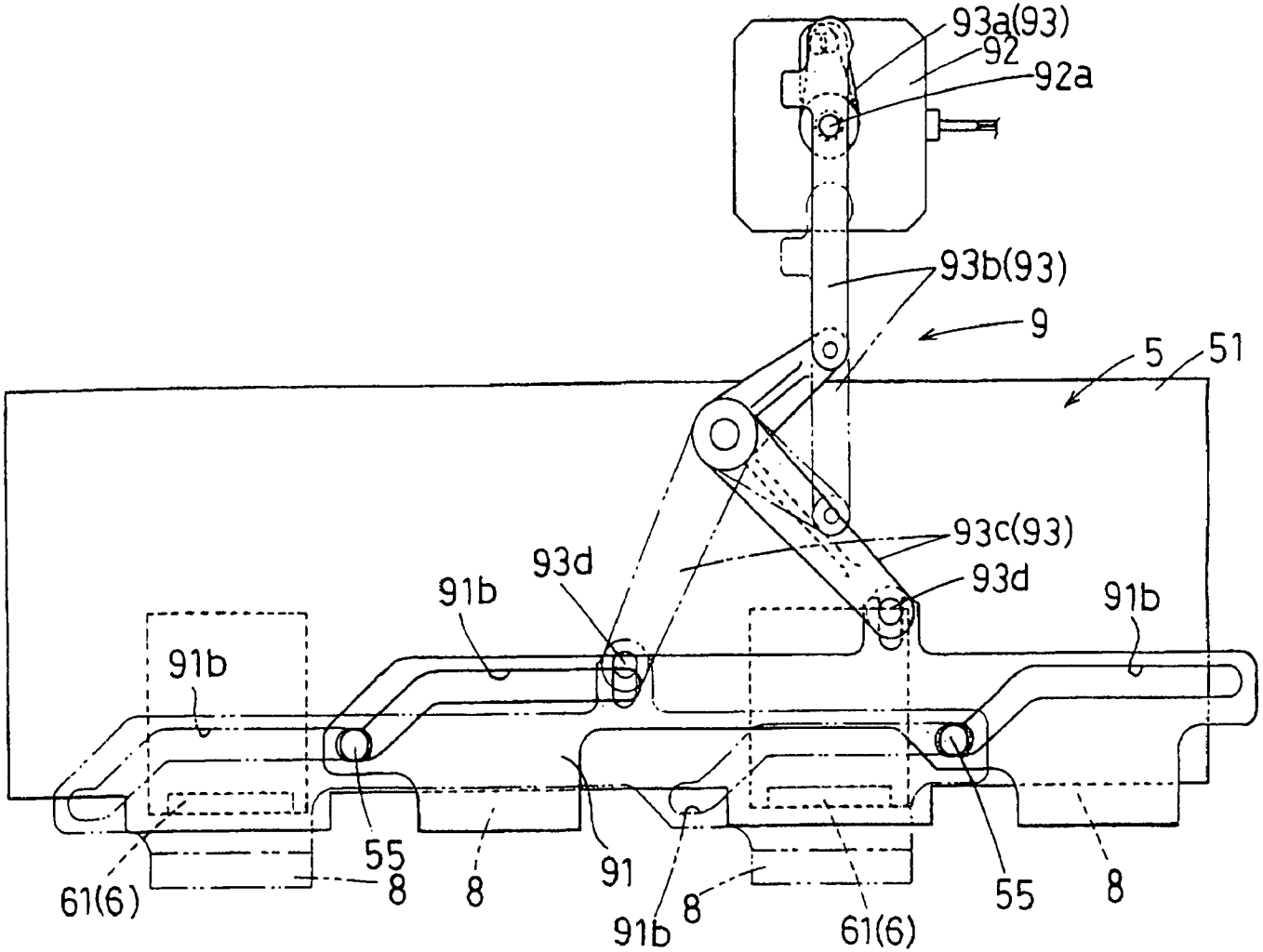
FIG. 8 is a second embodiment and an explanatory view showing the relationship between a carriage having two ink heads and a link mechanism.

Furthermore, in the embodiment described above, the carriage 5 equipped with the ink head 6 including eight unit heads 61 is described, however, in the invention, the structure in which the carriage is only raised and lowered with respect to the setting surface 21 is employed, so that the invention is applicable to a carriage 5 including two ink heads 6 each including eight unit heads 61 as in the case of the second embodiment shown in FIG. 8.

In the second embodiment, the ink receiving part 8 is provided for each of the two ink heads 6, and two tray-shaped ink receiving parts 8 used in the above-described first embodiment are used, and these ink receiving parts 8 and 8 are supported by the receiving part holder 91.

In detail, first, the ink receiving part 8 has the same structure as in the first embodiment shown in FIG. 4, wherein the ink receiving part is long in length in plan view and provided with a concave-shaped receiving surface 81 for receiving ink from all the unit heads 61 of the ink head 6, and disposed below the carriage case 51.

The receiving part supporting means 9 comprises a receiving part holder 91 to which the ink receiving part 8 is attached, a receiving part moving motor 92, and a link mechanism 93 which links the receiving part drive shaft 92*a* of the receiving part moving motor 92 and the receiving part holder 91, and moves the receiving part holder 91 so that the ink receiving part 8 can move between the ink receiving position and the withdrawn position according to the rotational driving of the receiving part moving motor 92.

The receiving part moving motor 92 and the link mechanism 93 have the same structures as those of the first embodiment shown in FIG. 2 through FIG. 4, so that description thereof is omitted.

Figure 6:
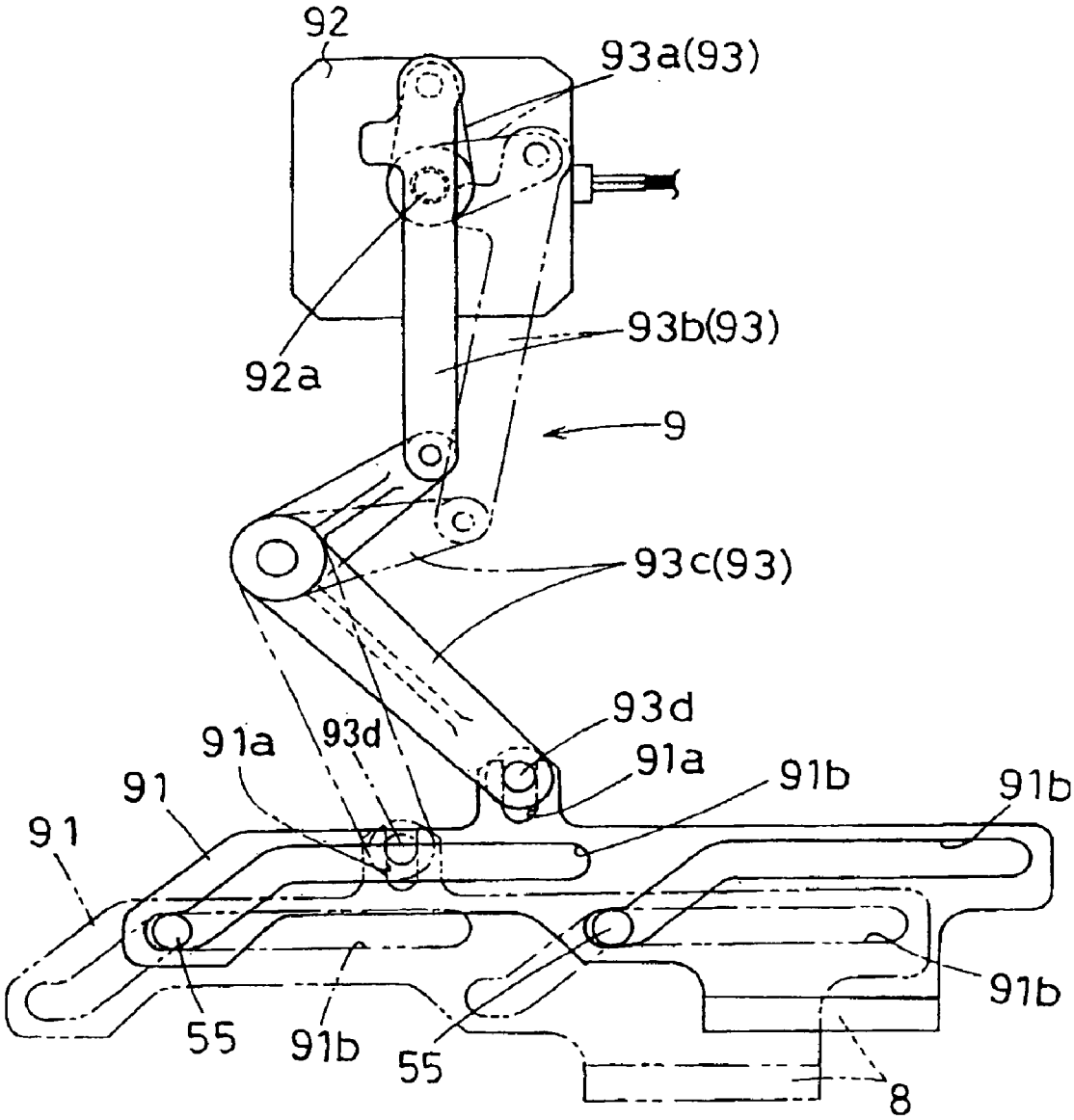
FIG. 6 is a motion explanatory view of a link mechanism relating to the first embodiment.
Figure 7:
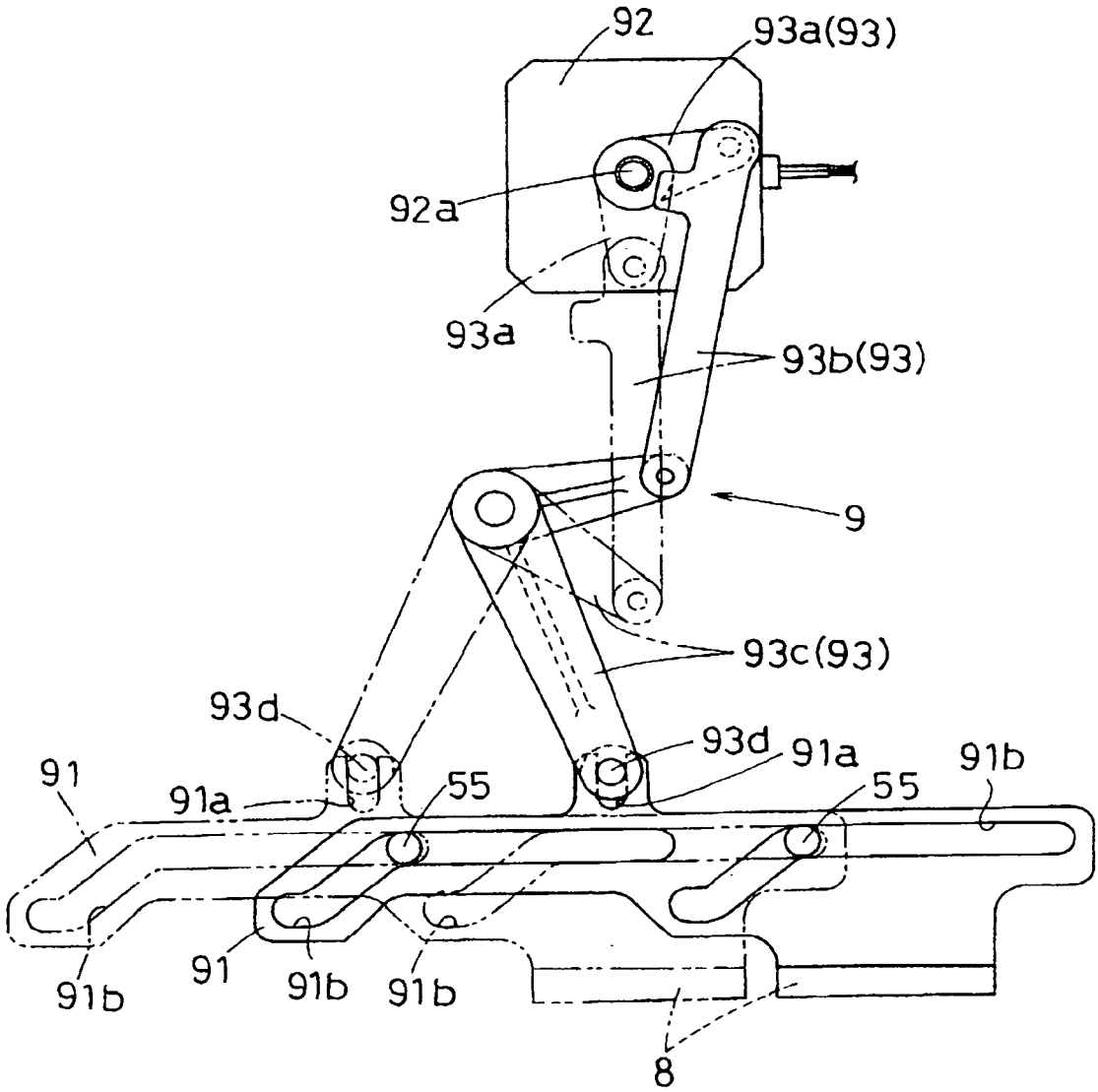
FIG. 7 is a motion explanatory view of the link mechanism relating to the first embodiment.

The receiving part holder 91 of the second embodiment is formed of, as shown in FIG. 8, a long-length member to be fixed to both ends in the lengthwise direction of the ink receiving part 8, and in order to support two carriages one of which is shown in the first embodiment, the receiving part holder is formed longer than the receiving part holder 91 of the first embodiment shown in FIG. 6 and FIG. 7.

Then, the receiving part holder 91 of the second embodiment is also formed with a concave groove 91*a* into which the holder linking pin 93*d* of the link mechanism 93 is fitted and two V-shaped guide holes 91*b* into which guide pins 55 projectedly provided on the carriage case 51 are fitted. The receiving part holder 91 is disposed on the carriage case 51 so that its lengthwise direction becomes horizontal.

At two points in the lengthwise direction of the lower part of the receiving part holder 91, the ink receiving part 8 is attached.

In the second embodiment, the carriage is also formed to be movable up and down and flushing can also be carried out as appropriate even during printing by advancing the ink receiving part 8 to the ink receiving position when the carriage 5 is separated from the printing position.

As a result, even without the conventional swinging mechanism for swinging the carriage, printing can be carried out while flushing is carried out as appropriate without an increase in size of the apparatus and without an increase in printing period, whereby the printing yield is improved overall.

Furthermore, according to the second embodiment, when it is desired to increase the ink types to improve printing performance, even if the number of unit heads of the ink head is increased and the carriage is increased in size, the distance of raising and lowering the carriage is the same as in the case of the first embodiment. Therefore, the number of unit heads can be increased without lengthening the distance of raising and lowering, and the printer 2 is not entirely increased in size vertically.

Furthermore, two ink receiving parts 8 can be made to advance and retreat by the one receiving part moving motor 92 and the link mechanism 93, so that the two ink receiving parts 8 can be operated by using a common driving source without an increase in number of parts.

What is claimed is:

1. A printing apparatus which includes a printer body having a setting surface on which a printing surface of a printing medium is set horizontally, a carriage beam which is attached to the printer body and extends in the direction along the setting surface, and a carriage provided so as to be movable in the beam lengthwise direction with respect to the carriage beam, and further includes an ink head equipped with a nozzle for discharging ink provided in the carriage, comprising:

a carriage supporting means which supports the carriage onto the carriage beam in a manner enabling it to move up and down, an ink receiving part which receives ink that is discharged from the ink head, and a receiving part supporting means which supports the ink receiving part on the carriage in a manner enabling it to reciprocate between an ink receiving part below the ink head and a withdrawn position separated from the ink head while maintaining the horizontal posture.

2. The printing apparatus according to claim 1, wherein the receiving part supporting means comprises a holder to which the ink receiving part is attached, a receiving part moving motor, and a link mechanism which links a drive shaft of the receiving part moving motor and the holder to each other and moves the holder according to the rotational driving of the receiving part moving motor so that the ink receiving part can reciprocate between the ink receiving position and the withdrawn position while maintaining the horizontal posture.

3. The printing apparatus according to claim 2, further comprising a control means which drives the carriage supporting means to lower the carriage to a position enabling the ink head to carry out printing and drives the receiving part supporting means so that the ink receiving part is positioned at the withdrawn position when printing by the ink head is carried out, and drives the carriage supporting means to raise the carriage and drives the receiving part supporting means so that the ink receiving part is positioned at the ink receiving position to carry out ink flushing when printing by the ink head is not carried out.

4. The printing apparatus according to claim 1, further comprising a control means which drives the carriage supporting means to lower the carriage to a position enabling the ink head to carry out printing and drives the receiving part supporting means so that the ink receiving part is positioned at the withdrawn position when printing by the ink head is carried out, and drives the carriage supporting means to raise the carriage and drives the receiving part supporting means so that the ink receiving part is positioned at the ink receiving position to carry out ink flushing when printing by the ink head is not carried out.

* * * * *